US005520479A

United States Patent [19]

Hernandez

[11] Patent Number: 5,520,479

[45] Date of Patent: May 28, 1996

[54] REMOVABLE SECURITY POST ASSEMBLY

[76] Inventor: Rigoberto Hernandez, 5371 W. 4 Ct., Hialeah, Fla. 33012

[21] Appl. No.: 310,602

[22] Filed: Sep. 22, 1994

[51] Int. Cl.[6] ..... E01F 13/04

[52] U.S. Cl. ..... 404/6; 49/35; 49/49; 49/131; 256/13.1

[58] Field of Search ..... 404/6, 9, 12, 13; 52/298; 119/786; 49/35, 49, 131; 256/1, 13.1

[56] References Cited

U.S. PATENT DOCUMENTS

| | | | |
|---|---|---|---|
| 3,061,960 | 11/1962 | Dull | 49/35 |
| 3,660,935 | 5/1972 | Boots | 49/35 |
| 4,062,149 | 12/1977 | Collins | 49/35 X |
| 5,192,159 | 3/1993 | Higginson . | |
| 5,365,694 | 11/1994 | Macaluso | 49/49 |

FOREIGN PATENT DOCUMENTS

| | | | |
|---|---|---|---|
| 4030458 | 4/1991 | Germany | 49/35 |

*Primary Examiner*—Ramon S. Britts
*Assistant Examiner*—James A. Lisehora
*Attorney, Agent, or Firm*—J. Sanchelima

[57] ABSTRACT

A removable post assembly for securing an area including basically four parts: an underground base member, a removable post member, a hinge assembly and a locking mechanism. The underground base member includes a housing that partially receives the post member and an anchorage assembly mounted to the housing assembly. The hinge assembly includes two leaves and one of them is pivotally mounted to the housing at a position substantially adjacent to the ground level. The locking mechanism locks the other hinge leaf to the removable post member. A cover is rigidly mounted to the post member so that it houses the locking mechanism thereby protecting it from tampering. The cover includes a bottom opening that permits a user to insert a key or otherwise release the locking mechanism. The bottom opening is sufficiently close to the ground level to prevent the introduction of any tampering tools.

6 Claims, 3 Drawing Sheets

REMOVABLE SECURITY POST ASSEMBLY

BACKGROUND OF THE INVENTION

1. Field of the Invention

The present invention relates to removable security posts, and more particularly, to the type that is removably anchored to the ground.

2. Description of the Related Art.

Applicant believes that the closest reference corresponds to U.S. Pat. No. 5,192,159 issued to Higginson in 1993 for a security post. Higginson's patent discloses a security post that is installed below the ground. However, it differs from the present invention in that the locking mechanism is exposed and easily broken by a wrongdoer. Also, the alternate embodiment herein provides means for securing trailers with tubular members. Higginson patent does not suggest the characteristics claimed in the present invention, as set forth below.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a removable security post assembly with a protected mechanism that cannot be broken unless specialized tools are used.

It is another object of this invention to provide a removable security post assembly that, when removed, does not leave any irregularities on the ground.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWING

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
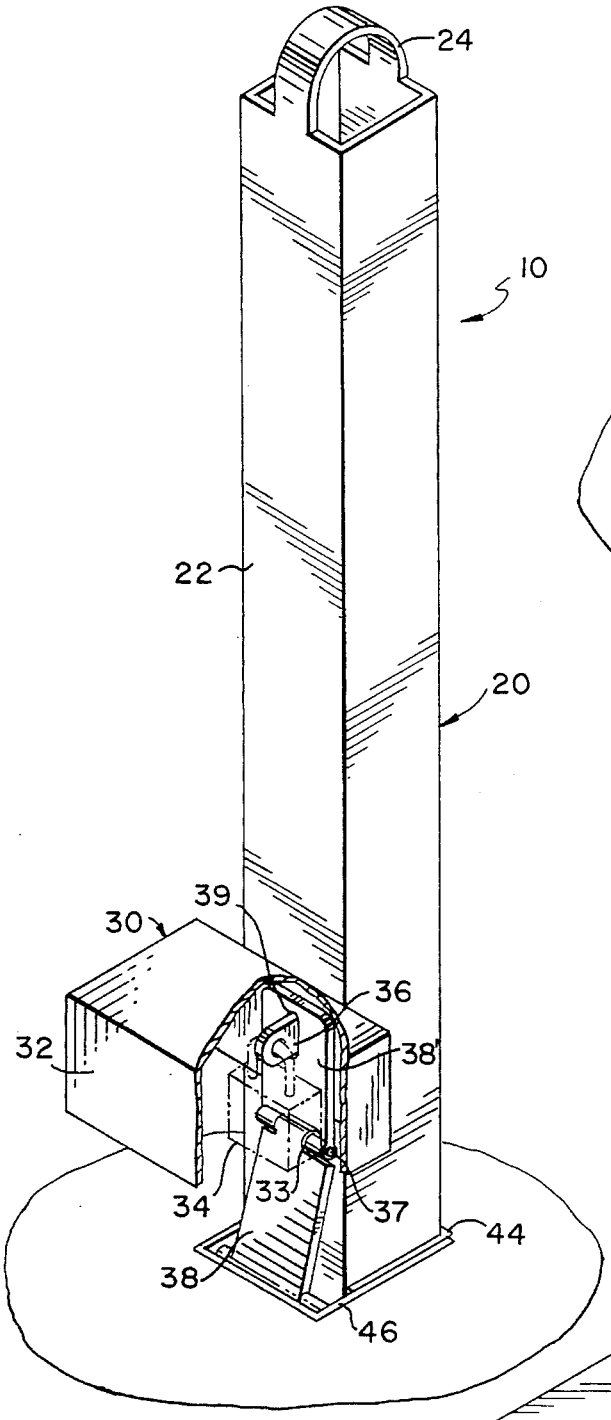
FIG. 1 is an isometric view of the present invention.

Referring now to the drawings, where the present invention is generally referred to with numeral 10, it can be observed that it basically includes a removable post member 20 and a receiving underground base assembly 40. Removable post member 20 is maintained vertically by housing member 44, inside which member 20 penetrates a sufficient predetermined distance, which in the preferred embodiment is 20 cm. Locking assembly 30 keeps removable post member 20 locked to receiving underground base 40.

Locking assembly 30 includes hinge leaf 38 and slotted leaf 38', which are both joined by joint member 33 and pivot pin 37. Pin 47 provides a pivoting point for hinge leaf 38. Pin 47 is rotably mounted to recessed hinge support assembly 46. Eye plate 36, slot 39 and padlock 34 are protected by cover member 32. Cover member 32 has, in the preferred embodiment, a protective rectangular box shape with an opening through bottom that provides the necessary access to padlock 34. In practice, a wrongdoer would have to use a welding torch to remove cover member 32 before he can break padlock 34. Typically, these tools are not readily available.

Figure 2:
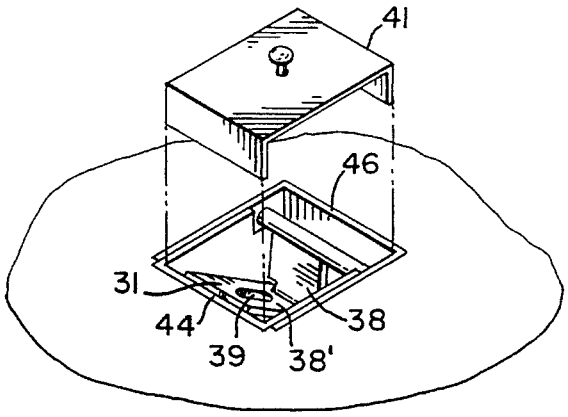
FIG. 2 shows the present invention after the post member has been removed and the cap member is about to be placed over the upper opening of the receiving base. This figure shows the manner in which locking members are stored within the tubular housing member.
Figure 3:
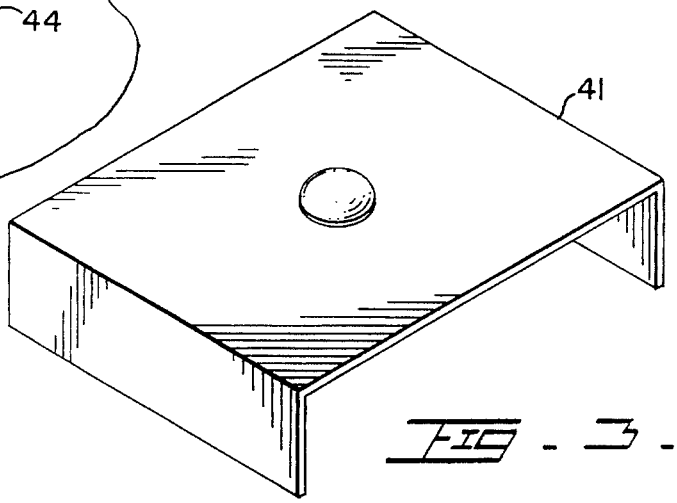
FIG. 3 is an isometric view of the cap member.

Tubular member 22, when removed, does not leave any irregularities on the ground. Folded locking assembly 31 is stored inside receiving underground base 40 and the opening is covered with cap member 41, as best seen in FIG. 2.

Figure 4:
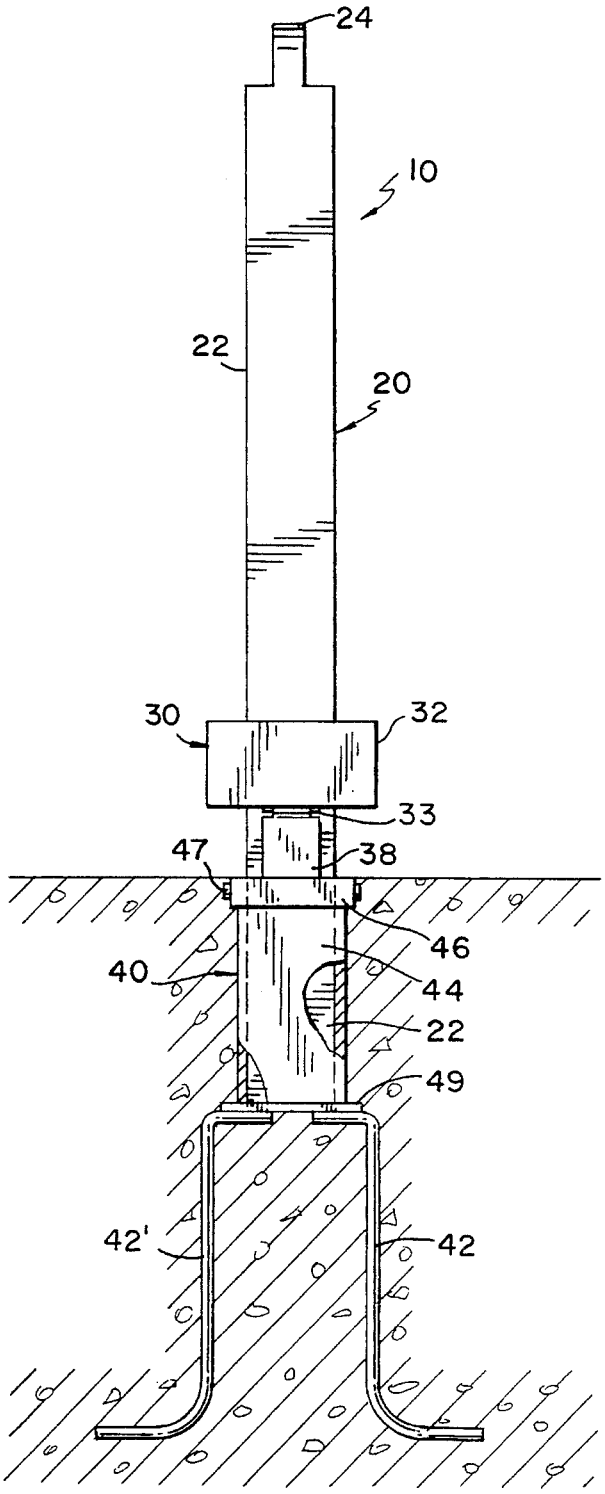
FIG. 4 shows an elevational front view of the present invention above and below the ground level and a partial cross section of the receiving underground base housing the inferior part of the removable security post member.
Figure 5:
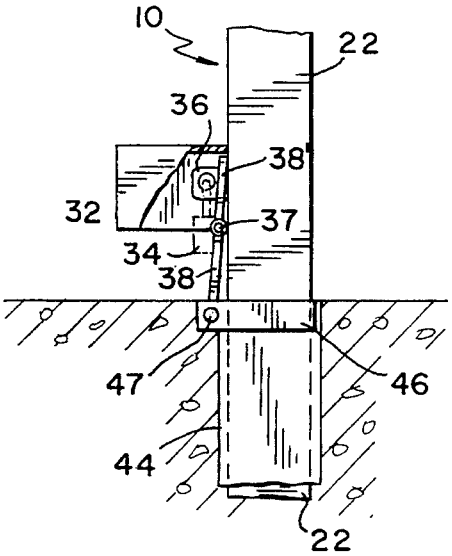
FIG. 5 represents a partial elevational side view of the removable security post assembly shown in FIG. 4.

Removable security post assembly 10 is installed partially below the ground, as shown in FIG. 4. In the preferred embodiment, the installation is accomplished by pouring concrete around anchorage members 42 and 42'. Tubular housing member 44 cooperatively receives one end of tubular member 22. Plate 49 is rigidly mounted to the bottom of tubular housing member 44, thereby providing support for the end of tubular post member 22. Anchorage members 42 and 42' are rigidly mounted to the underside of plate 49. In this manner, receiving underground base 40 is structurally anchored to the ground, thereby providing firm support to removable post member 20.

Figure 6:
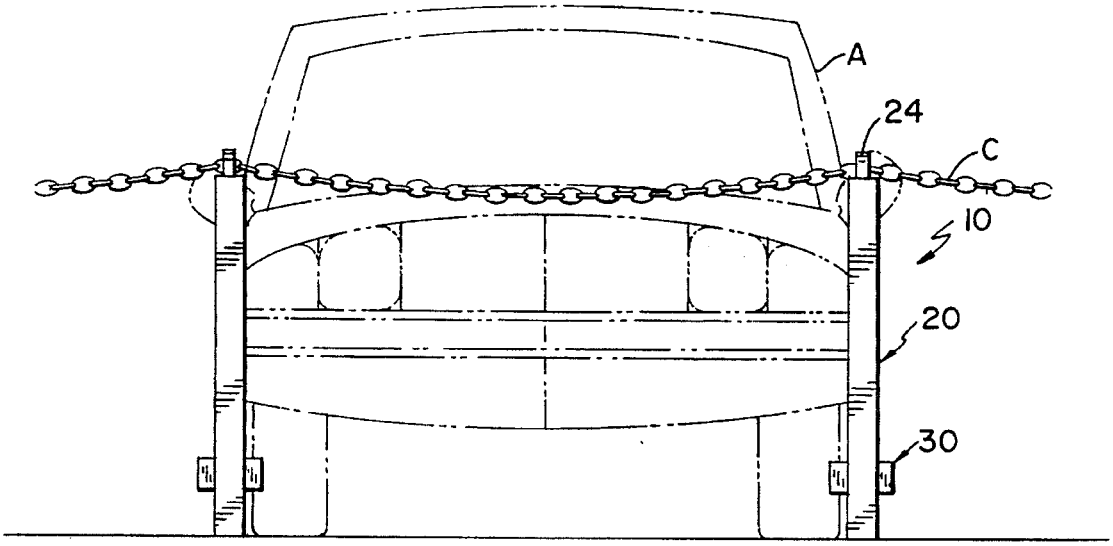
FIG. 6 shows one of the applications for the present invention in a car lot.

Chain loop member 24 is designed for holding a chain C through it in order to secure automobiles A in a given area, as it can be seen in FIG. 6. This is particularly useful in car dealers lots.

Figure 7:
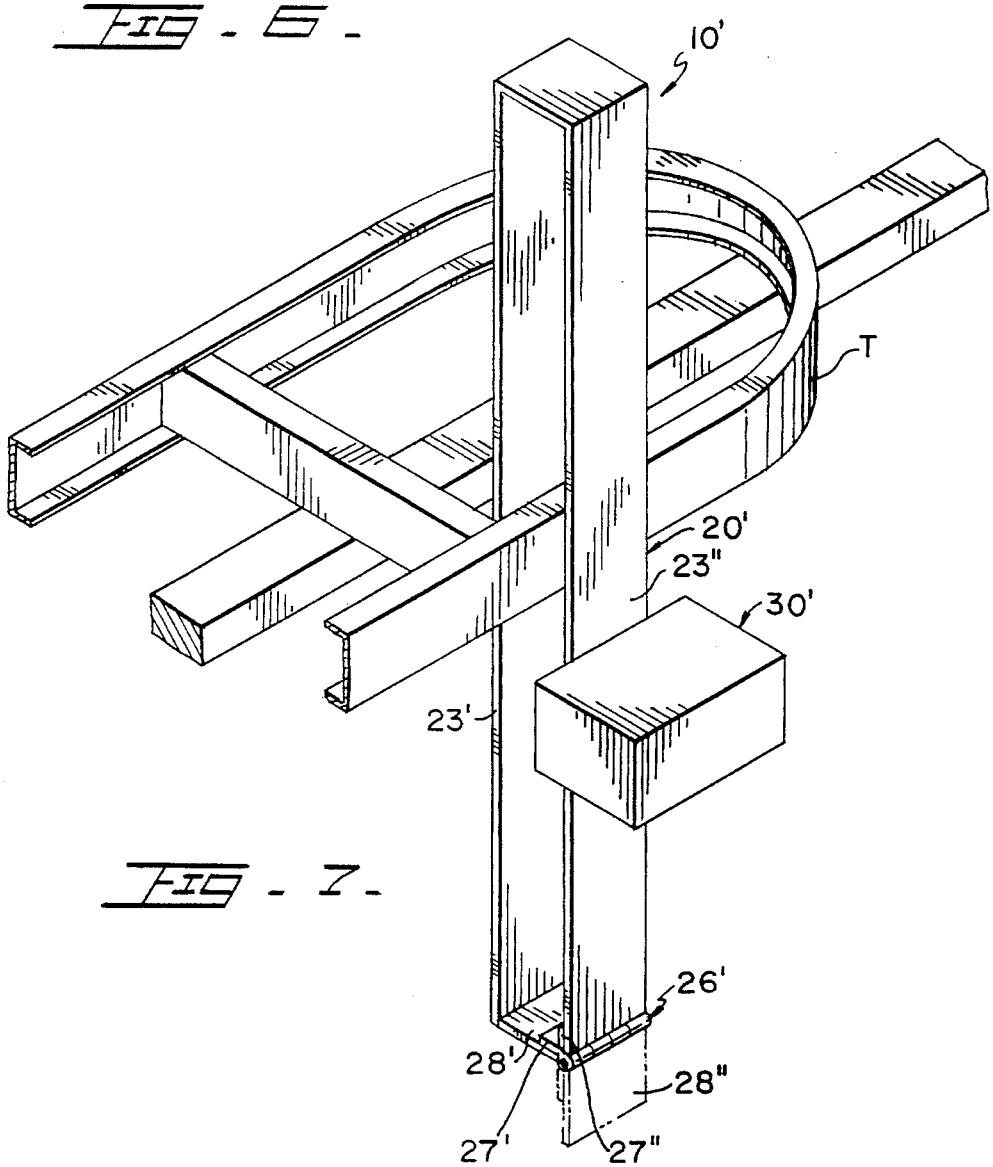
FIG. 7 illustrates an isometric view of an alternate embodiment being used to secure a trailer.

In FIG. 7, an alternative embodiment is referred to with numeral 10'. Alternate removable post member 20' is similar to removable post member 20 in the preferred embodiment except that it includes two lateral walls 23' and 23" in a spaced apart and parallel relationship to each other. Hinge assembly 26' is mounted to the free end of wall 23'. Leaf 27" is rigidly mounted to the inner surface of wall 23". Leaf 27' is rigidly mounted to spacer member 28', which swings to position 28" when is not placed inside underground base 40. When inside base 40, spacer 28' comes up between the free ends of walls 23' and 23", thereby maintaining a determined distance between the ends of walls 23' and 23". In this manner, more structural integrity is provided to members 23' and 23". This permits a user to insert removable post member 20' through the chassis of trailer T, or equivalent vehicle.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

I claim:

1. A removable security post assembly, comprising:

A. a base member positioned below ground level and including housing means having first and second ends and said first end being adjacent to the ground level, and said base member further including anchorage means rigidly mounted to said housing means;

B. an elongated post member removably and partially received within said housing means, and said elongated post member having first and second post member ends;

C. hinge means having first and second leaves and said first leaf being pivotally mounted to said first end; and D. locking means including a lock for selectively securing said second leaf to said elongated post member.

2. The post assembly set forth in claim 1 further including rigidly mounted covering means enclosing said locking means except from the bottom where an opening is defined and said cover means and locking means positioned adjacent to the ground level so that a user can only release said lock from said opening.

3. The post assembly set forth in claim 2 wherein said elongated post member includes two elongated wall members, and further including separating means for keeping said elongated wall members in a spaced apart and parallel relationship with respect to each other.

4. The post assembly set forth in claim 3 further including spacer means pivotally mounted to said first post member end and having cooperative dimensions that bring said spacer means between the second post member ends so that the structural integrity of said elongated post member is enhanced when said post member is placed inside said housing means.

5. The post assembly set forth in claim 4 wherein said separating means includes a loop rigidly mounted thereon.

6. The post assembly set forth in claim 5 wherein said housing means further includes a recessed support assembly for said first hinge leaf thereby permitting said first hinge leaf to be pivotally mounted adjacent to said removable post member without obstruction and said hinge means being completely enclosed within said housing means when said removable post member is removed.

* * * * *